United States Patent [19]

Courtay

[11] Patent Number: 4,534,653

[45] Date of Patent: Aug. 13, 1985

[54] BLENDER FOR POWDERY MATERIAL

[75] Inventor: Robert Y. Courtay, Bretigny sur Orge, France

[73] Assignee: Fuller Company, Bethlehem, Pa.

[21] Appl. No.: 580,980

[22] Filed: Feb. 16, 1984

[51] Int. Cl.[3] ..... B01F 13/02

[52] U.S. Cl. ..... 366/106; 222/195; 366/107; 406/85

[58] Field of Search ..... 366/15, 101, 103–107, 366/132, 134, 153, 179, 181, 182, 336, 341; 99/646 S; 52/192, 197; 222/55, 195, 564, 630, 637; 406/12, 23, 90, 91, 138, 137, 136, 85

[56] References Cited

U.S. PATENT DOCUMENTS

| | | | |
|---|---|---|---|
| 2,665,035 | 1/1954 | Schemm | 366/101 X |
| 4,078,703 | 3/1978 | Dressler | 366/101 |
| 4,172,539 | 10/1979 | Botkin | 366/107 X |
| 4,239,421 | 12/1980 | Krauss | 406/12 |
| 4,273,451 | 6/1981 | Krauss | 366/101 |
| 4,352,569 | 10/1982 | Krauss | 366/107 |
| 4,375,335 | 3/1983 | Klein-Albenhausen | 366/134 X |

*Primary Examiner*—Timothy F. Simone
*Attorney, Agent, or Firm*—Frank H. Thomson

[57] ABSTRACT

A combined storage silo and homogenizing device for powdery materials such as cement raw meal. A silo is divided into an upper storage vessel and a lower homogenizing chamber. The storage silo has a slab floor having a plurality of spaced apart openings therein which serve as outlets for the vessel and communicate with inlets for the homogenizing chamber. The homogenizing chamber includes a small pneumatic blending device having a lateral outlet in its bottom feeding blended material to a column having a top outlet for the device.

2 Claims, 4 Drawing Figures

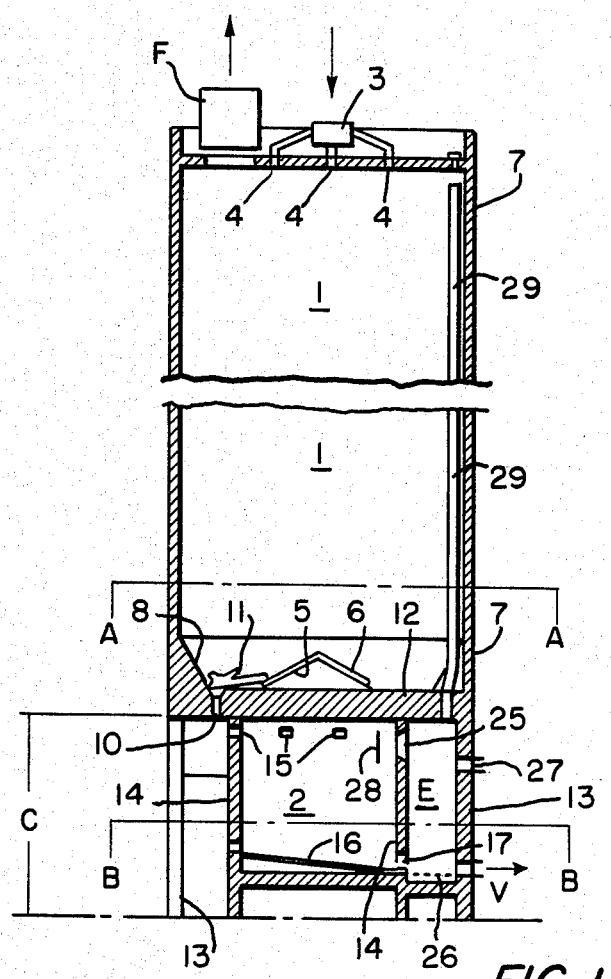
FIG. 1
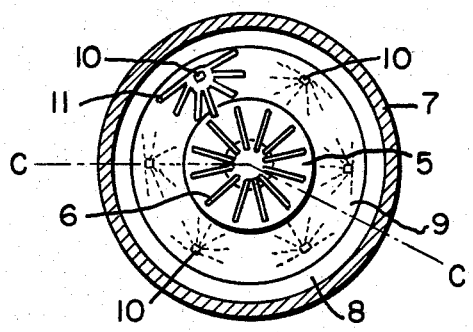
FIG. 2
FIG. 3
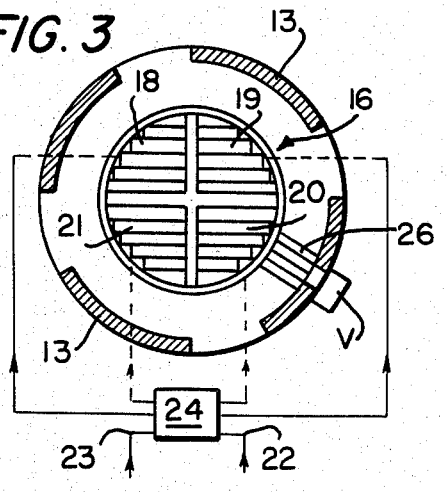
FIG. 4
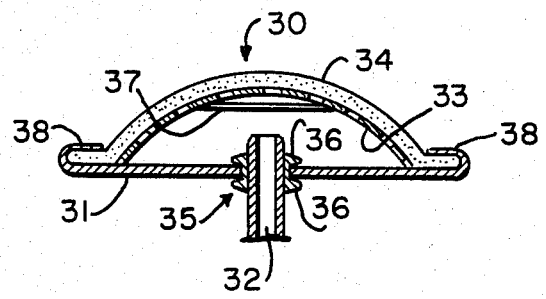

BLENDER FOR POWDERY MATERIAL

This invention relates to an assembly for the storage and homogenization of powdery products, in particular, manufacturing products which are used in the field of cement making.

Prior to the present invention it was known, in the case of the manufacture of cement, that crushed raw material should be subjected to storage and homogenization prior to the next manufacturing operation, i.e., calcining and clinkering in the kiln in order to enable the kiln to operate under the most favorable conditions. The present invention is directed to an effort to reduce to a minimum the requirements of homogenizing apparatus in terms of large and expensive installations and to guarantee the storage and homogenization of raw materials in the most compact and the most economical manner, especially with respect to electric energy consumption in the homogenization process. In the present invention, the treatment and transfer of material is performed in fluidized beds.

Prior to the present invention, there have been proposals for assemblies of this type, using very little in the way of aerated surfaces in relation to the volume to be treated; but they need "civil engineering" which is quite expensive and adds to the cost of an installation, in spite of the savings made during actual installation operations. It has been proposed that installations be made, comprising a mixing chamber incorporated in a storage silo; but the quantities of material taken out of the silo are only partially mixed, the supply of material to the mixing chamber being rather unsteady, without any possibility of direct intervention and effective regulation. Furthermore, prior installations result in irregular withdrawals and tend to result in the formation of preferential circuits or "rat holes" in the material which bring about an imbalance in the content of the silo and therefore in the homogeneity of the mixture. The operation of prior installations thus appears uncontrollable. Further, the silos of the prior art have a reduced storage capacity as compared with the present invention.

It is the principal object of the present invention to remedy the inconveniences of the prior art indicated above by providing a compact storage and homogenization assembly with a high capacity, that is, both efficient and reliable, and in which all elements are geared toward savings in energy and a reduction in cost while permitting easier operations.

According to the invention, the storage and homogenization assembly is of the type for the treatment and transfer of powdery substance through fluidized beds. A storage silo is separate from the homogenization chamber and is superimposed upon the latter by means of a separation slab equipped with several equidistant gravity supply openings leading to said chamber, the upper part of the silo having a plurality of inlets at several points for the crushed raw material, the bottom of said silo includes a cone with a slight slope, equipped with first fluidization elements as well as a crown of second fluidization elements, and supply openings for the homogenization chamber being arranged in the upper part of that chamber while its floor, which is flat and inclined toward a discharge outlet, covers the entire floor of the homogenization chamber and is designed to achieve a fluidization by zones, the outlet from the homogenization chamber being arranged laterally with respect to the lower part of the latter.

The inlet into the silo includes a plurality of openings which are supplied with material simultaneously or in sequence by a fluidized-bed distributor, while its outlet is made up of openings in the separation slab that can be opened in a cyclical fashion and with an open duration that can be adjusted for each of the openings;

Fluidization elements are made up of ramps comprising a flat bottom equipped with an air inlet and topped by a convex porous hood held in place by means of bending the edges of said flat bottom.

Other features and advantages of the invention will emerge better from the following description given with respect to the attached drawings where:

FIG. 1 is a schematic elevation cross-section view of an assembly according to the invention, the lower part C of said figure constituting a view along C—C in FIG. 2;

FIG. 2 is a schematic view of the floor of the silo along A—A in FIG. 1;

FIG. 3 is a diagramatic view of the floor of the homogenization chamber along B—B of FIG. 2, with a schematic diagram of the air circuits; and FIG. 4 is a diagramatic transversal cross-section view of a porous fluidization element at the bottom of the silo, according to the invention.

In the drawings, similar reference numbers designate similar parts.

Referring now to FIGS. 1–3, the homogenizing or blending apparatus according to the invention has a generally cylindrical shape and compromises a storage silo 1, superimposed on a homogenization chamber 2 with which it communicates in the manner that will be explained below. Silo 1 comprises, in its upper part, a supply or feed member 3 for raw, crushed products to be blended which are suitably supplied thereto by any means such as a pneumatic transporter. In this case, the supply member 3 consists of a distributor with a gas permeable floor over its entire surface to permit material within the vessel 3 to be fluidized. The member 3 opens up into the silo for example at six equidistant points 4, in the known manner. The venting of the transport fluid takes place through an appropriate filter F which is also arranged in the upper part of silo 1.

The floor 12 of silo 1 in its center has a cone 5 with a slightly inclined slope, along an angle of approximately 10°–15° provided with fluidization elements 6 along its surface. At the base of its interior skirt 7, the floor of the silo has a reduced diameter forming a conical bottom 8 whose small diameter with respect to cone 5 describes a ring-shaped space or crown 9 (FIG. 2), equipped, for example, with six equidistant circumferentially spaced apart openings 10 in the form of vertical opening through the floor 12, each arranged at the center of a set of porous aeration units 11 arranged in a radiating fashion. These openings 10, with the fluidization equipment units 11, constitute the communication passages between silo 1 and homogenization chamber 2. Of course, each opening 10 is also equipped—under the floor 12 of the silo's bottom, with fluidization box, a pneumatic-control register, and a manual isolation trap, in a known manner.

When in operation, fluidization in the area of the openings 10 takes place in a cyclic manner through units 11, in the same way as the opening of the six valve means, in a programmable and controlled manner. It should be noted that if all the supply of raw material to silo 1 is accomplished simultaneously through all points 4, and if extraction of material from silo 1 through the plurality of openings 10 is accomplished in a cyclic manner by opening the openings 10 in sequence, the material undergoes statistical mixing through regular flow causing a constant descent of material from silo 1. Openings 10 can work on opposite sides as compared with inlet points 4.

As indicated above, the storage silo 1 is superimposed upon homogenization chamber 2 and the slab of bottom 12 is supported, on the one hand, by the outside skirt 13 and, on the other hand, by skirt 14 of the homogenization chamber 2. According to the invention, the height of chamber 2 is essentially in a ratio of 1:1 with its diameter so as to reduce the power necessary for fluidization air supply; in this way, chamber 2 permits the utilization of a relatively low pressure blower which are more economical in terms of energy than higher pressure compressors required in prior devices.

Homogenization chamber 2 essentially has a cylindrical shape and, along the periphery of its upper part, it has several openings 15 which are circumferentially spaced apart, for example, six openings corresponding in number and location to openings 10 in slab 12 for the separation of the silo and chamber 2, guaranteeing the supply of said chamber by gravity flow from the silo 1 through openings 10 and 15 into chamber 2.

Bottom 16 of homogenization chamber 2, covers its entire surface. It has a generally flat shape and it is inclined in the direction toward a lower opening 17 of the skirt 14, opening up into an extraction column E. In the known manner, bottom 16 is of the type divided into zones, for example, four quadrants, respectively, 18, 19, 20, and 21, which operate in sequence, one zone being active while the three others are inactive; see for example U.S. Pat. No. 2,844,361. For this purpose, blowers (not shown) supply, respectively, an active air conduit 22 and an inactive air conduit 23 linked to a rotating automatic valve 24 from which leave the distribution conduits for each of the zones 18, 19, 20 and 21.

The homogenization chamber 2 includes an outlet 25 which is arranged laterally in the upper part of skirt 14 and which is connected to the extraction column E. At the base of the column E there is arranged a suitable means 26, for fluidizing the material thereabove within the column E. A normally closed emptying outlet V is positioned in the bottom of the column E.

During operation, the material is introduced by means of gravity from silo 1 through openings 10 and 15. The material undergoes mixing in chamber 2 by means of air under pressure being supplied through gas permeable bottom 16 to fluidize the material. The thus mixed material then passes through the lower opening 17 into the extraction column and then goes back up to the height of the outlet 27 from which it is extracted. A deflector 28 is furthermore arranged inside chamber 2, forward of the outlet 25, in order to allow the passage, possibly, through the latter, of only that substance which has undergone homogenization. The deflector plate prevents direct passage of material from inlets 15 to outlets 25.

A level measurement device (not shown) is included in the extraction column E and it is linked to the extraction control valves in order to maintain an optimum material level in the chamber 2. This level measurement device can be of any known type.

The venting of chamber 2 is provided by a column 29 whose base is arranged above the fluidization elements 26 which are supplied with active air. The outlet of column 29 is in the upper portion of the storage silo 1.

According to the invention and for the purpose of saving substance and energy, each element constituting the fluidization or aeration equipment units 6 and 11 is made up of an open conduit 30 (FIG. 4), consisting of a ramp comprising a flat bottom 31, equipped with an air inlet 32 and topped by a convex porous hood, which in turn is made up of a rigid perforated support 33, covered with a sheet of suitable porous material 34. In a particularly advantageous manner, an air inlet conduit 32 is mounted on an opening in bottom 31 by means of a flexible sealing joint 35 whose inside face conforms to the outside periphery of the conduit and whose outside portion comprises elements 36 sealing the edge of the opening of bottom 31. An interior reinforcement 37, placed upon the perforated support 33, prevents any deformation of the open conduit 30, while the upper hood is simply kept in position by the setting of the edges 38 of the plate forming the flat bottom 31 and folded over on the edges of the sheet 34.

The storage and homogenization assembly as described above comprises furthermore all of the necessary control members, such as inspection gates, isolation traps, programming and observation, manual, emergency and instant-action control duplication facilities. This provides a reliable and compact installation, in particular presenting the following advantages: Moderate civil engineering investment, moderate air source investment, moderate electric power consumption, guarantee of total emptying (at V in FIG. 1), efficient supply control, possibility of instant action in homogenization chamber while retaining great storage capacity. It should be noted more particularly that, according to the invention, the storage operation (at 1) comes before homogenization (at 2) which offers the advantage of using the product coming directly from the latter, contrary to known installations where storage is performed in the homogenized state which can lead to loss of homogeneity.

It is of course understood that this invention was described and illustrated here only by way of explanation and without any limitation and that one could introduce any useful modification in it, especially in the area of technical equivalences, without going outside its framework.

I claim:

1. An apparatus for the storage and homogenization of powdery materials comprising an upper storage silo superimposed atop a homogenization chamber and separated by a slab; said upper storage silo including a plurality of feed points for raw material; the bottom of said silo being defined by said slab and including a cone having first fluidization elements mounted thereon and a plurality of circumferentially spaced apart generally vertical openings through the slab which define the outlet of the silo; each of said openings through slab being positioned at the center of a plurality of radiating second fluidization elements; said homogenization chamber including a plurality of circumferentially spaced apart openings in the upper part thereof, each flow connected to the outlet of the storage silo; the bottom of said chamber being generally flat and inclined toward a lateral outlet positioned on one side of the homogenization chamber; said bottom of the silo being adapted to fluidize material in the chamber by zones for homogenizing material therein; and an extraction column having an inlet at the bottom thereof flow connected to the lateral outlet of the homogenization chamber and an outlet in the upper portion thereof which serves as an outlet for the apparatus.

2. An apparatus for the storage and homogenization of powdery materials according to claim 1 wherein each of the fluidization elements includes a flat bottom, a convex, porous hood including a porous material covering a rigid perforated support and secured to said flat bottom by folding the edge of the flat bottom over the edge of the porous material, and an inlet for air in the flat bottom.

* * * * *